United States Patent [19]

Berger

[11] Patent Number: 4,475,016

[45] Date of Patent: Oct. 2, 1984

[54] SWIMMER ARRIVAL SIGNAL PANEL

[75] Inventor: Gordon Berger, Quebec, Canada

[73] Assignee: Annesberg Associates N.V., Curacao, Netherlands Antilles

[21] Appl. No.: 420,806

[22] Filed: Sep. 21, 1982

[51] Int. Cl.[3] ..... H01H 3/02; H01H 35/00; A63K 3/00

[52] U.S. Cl. ..... 200/52 R; 200/86 R; 4/505

[58] Field of Search ..... 200/52 R, 86 R, 85 R; 307/119; 4/505; 272/1 B, 4

[56] References Cited

U.S. PATENT DOCUMENTS

| | | | |
|---|---|---|---|
| 3,436,504 | 4/1969 | Gatsonides | 200/86 |
| 3,522,398 | 7/1970 | Heimann | 200/86 R |
| 3,584,169 | 6/1971 | Leu | 200/85 |
| 3,590,181 | 6/1971 | Baran | 200/52 |
| 3,676,696 | 7/1972 | Leu et al. | 200/86 R |
| 3,745,275 | 7/1973 | Degiez | 200/86 R X |
| 3,784,768 | 1/1974 | Hunt | 200/86 R X |
| 3,916,214 | 10/1975 | Coble, Jr. et al. | 200/52 R |
| 3,920,940 | 11/1975 | Brown et al. | 200/52 R |
| 3,944,763 | 3/1976 | Beierwaltes | 200/52 R |
| 4,006,364 | 2/1977 | Suter | 307/119 |
| 4,117,283 | 9/1978 | Hurzeller et al. | 200/52 R |
| 4,292,696 | 10/1981 | Berger | 4/505 |

FOREIGN PATENT DOCUMENTS

| | | | |
|---|---|---|---|
| 572250 | 12/1975 | Switzerland | 272/4 |

*Primary Examiner*—J. R. Scott

*Attorney, Agent, or Firm*—Larson and Taylor

[57] ABSTRACT

A swimmer arrival signal panel is provided for locating at an end of a swimming lane. The panel may be mounted at the end of a pool or on a bulkhead and forms a permanent installation in the pool. The panel comprises a panel of non-conductive material, the bottom of the panel adapted for mounting at one end of a swimming lane below water level in the swimming pool, the panel being free to move forward when contacted by a swimmer. A first adjustment provides a distance of travel within a predetermined range for the panel, a second adjustment establishes the position of the panel within the distance of travel where a contact is activated to signal a swimmer's arrival, and an adjustable spring to determine force required to move the panel.

15 Claims, 6 Drawing Figures

SWIMMER ARRIVAL SIGNAL PANEL

FIELD OF THE INVENTION

This invention relates to swimming pools. More particularly this invention relates to swimmer arrival signal devices located at one or both ends of a competitive swimming lane in a swimming pool. The signal devices form a permanent installation at one or both ends of a swimming pool or on bulkheads or dividers within a pool.

BACKGROUND OF THE INVENTION

In competitive swimming, electronic timing devices are used to time swimmers in their individual swimming lanes. The timing systems preferably require a device at the end of the swimming lane to indicate when the swimmer completes each length or the complete race. The signal arrival devices in the past have been touch pads which are separately mounted in each lane on one or both ends of a swimming pool, or on one or both sides of a bulkhead or divider. These touch pads, however, are delicate devices and are not usually left in the pool otherwise they can become damaged during other aquatic activities. Thus considerable time must be spent in preparing a swimming pool for competitive swimming races, first installing the touch pads and connecting the electronic timing equipment, and then removing the pads and equipment when the races are over. Furthermore, removable touch pads, in order to comply with competitive swimming regulations, both International and North American, must not be thicker than ½ inch or 1 cm. This required minimum thickness limits the ruggedness and trouble free characteristics of touch pads.

SUMMARY OF THE INVENTION

It is a purpose of the present invention to provide a swimmer arrival signal panel which may be permanently installed at one or both ends of a competitive swimming lane in a swimming pool. Such a panel, being a permanent feature does not have to comply with the thickness limitations for removable touch pads. The panels are ruggedly constructed so that they do not become damaged when they remain in the pool, and form a normal end wall for an area in a swimming pool which is suitable for other aquatic activities, thus avoiding the necessity of having to remove the touch pads for non-racing activities such as water polo or general swimming. It is also a purpose of the present invention to provide a swimmer arrival signal panel which has an adjustable distance of travel when touched by a swimmer; an adjustment to establish location within the distance of travel that a switch is activated; and an adjustable spring so that the force to move the panel may be adjusted to suit particular swimming conditions. This latter adjustment ensures that the panels cannot move to activate the switch due to force of wave action created by swimmers in the pool.

The adjustment for a distance of travel of each panel and for an exact location within that distance of travel where the switch is activated, allows swimming lane lengths to be measured and adjusted to very accurate required tolerances. This is particularly important since races are timed in hundredths of a second. It also permits all swimming lanes in a pool to have lengths established to close tolerances and ensures that forces on each panel to activate the switches are similar.

Current rules governing swimming competitions require some form of back-up timing system which provides alternate times in the event that the electronic components of the primary timing system should fail. These back-up systems may take the form of overhead photographic cameras, or manually activated push button controls which can activate a second electronic timing system. The present invention incorporates a second set of contacts providing a completely independent switch at each swimming lane. This alternate switching system is activated in the same manner as the primary switching system and can be adjusted to close a circuit simultaneously with the first set of switches. Both sets of switches are activated when a swimmer touches the panel. The secondary circuit can be used to activate an independent timing apparatus.

The present invention provides a swimming arrival signal panel which may be permanently installed in a swimming pool. The panel moves a distance of travel which is adjustable at the top of the panel. When the swimmer arrival panels are not required for racing, they remain an integral part of an end wall, bulkhead or divider in the swimming pool. Conductors for the contact switches of the arrival panels may be mounted on non-conductive material which is permanently installed adjacent the arrival panels so that the only requirement for setting up the electronic timing devices is to connect the conductors to the timing circuits. Two separate switching circuits are provided to permit connection of a back-up electronic timing system.

In one embodiment, the switch is a non-corrosive depressible conductive tab positioned to be compressed thereby closing a circuit between the two conductors. The tab is easily cleanable in place and can be quickly replaced if needed.

The present invention provides a swimmer arrival signal panel for a swimming lane in a swimming pool, comprising a panel of non-conductive material, the bottom of the panel adapted for mounting at one end of the swimming lane below water level in the swimming pool, the panel being free to move forward when contacted by a swimmer; first adjustment means to provide a distance of travel within a predetermined range for the panel; contact means adapted to be activated when the panel is moved within the distance of travel; second adjustment means to establish the position of the panel within the distance of travel where the contact means is activated; and adjustable spring means to determine the force required to move the panel.

In a preferred embodiment the contact means includes at least one non-corrosive depressible conductive tab, being connected to a first conductor and being spaced from a contact forming part of a second conductor such that depression of the depressible tab touches the contact to complete an electrical circuit between the first and second conductors. Preferably two depressible tabs and contacts are provided on each panel. In one embodiment three signal panels are provided at one end of the swimming lane and within each swimming lane of the swimming pool, the panels being rectangular in shape and separated vertically so that each may move independently. Each panel is preferably made of vertical strips attached to reinforcing back-up bars. Preferably the strips are arranged with the space between strips substantially the same as the width of each strip so the contact surface area of the panel is reduced by approximately half. Furthermore the panel has no fixed attachment to the end of the swimming lane, and thus avoids stress build up in the panel itself.

In another embodiment, the signal panel is utilized on at least one side of a bulkhead or a divider in a swimming pool. In a further embodiment, the panel is utilized as a permanent fixture on an end wall of a swimming pool.

To comply with competition rules for swimming races, a first contact means and a second contact means are provided to provide a first signal and a back-up signal for two separate timing circuits.

In a still further embodiment, the first adjustment means includes at least one flexible strip with a retainer attached to the top of the panel, the retainer to engage the end of the swimming lane, and means to depress the flexible strip to release the retainer and disengage the top of the panel from the end of the swimming lane.

BRIEF DESCRIPTION OF THE DRAWINGS

In drawings which illustrate the embodiments of the invention.

DETAILED DESCRIPTION OF THE PREFERRED EMBODIMENT

Figure 1:
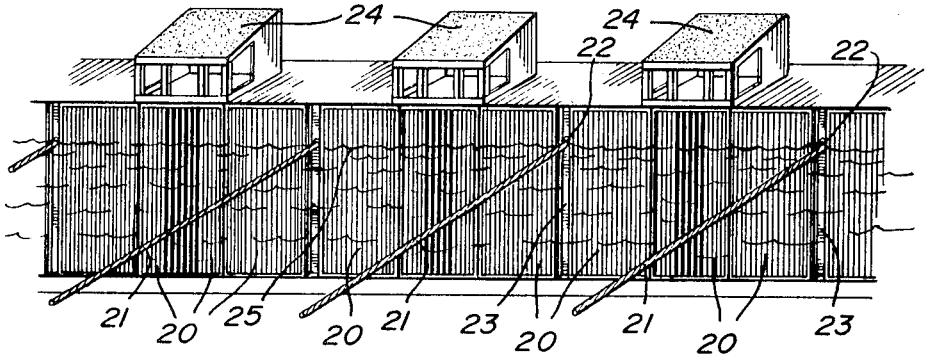
FIG. 1 is an isometric view of one end of a swimming lane in a swimming pool having swimmer arrival panels according to the present invention.

Referring now to the drawings, swimmer arrival panels may be permanently installed at one or both ends or sides of a swimming lane in a swimming pool. The panels may also be mounted on one or both sides of a bulkhead or divider within a swimming pool. In the embodiment illustrated in FIG. 1, three individual panels 20 are shown at one end of each of a number of racing swimming lanes which have buoyed rope dividers 21 fixed to anchor points 22 on rigid vertical strips 23 located at the end of the swimming pool between the swimming lanes. A starting platform 24 at the center of each lane is mounted on the edge of the pool. The water level 25 in the swimming pool is substantially at the same elevation as the rope anchor points 22.

Figure 3:
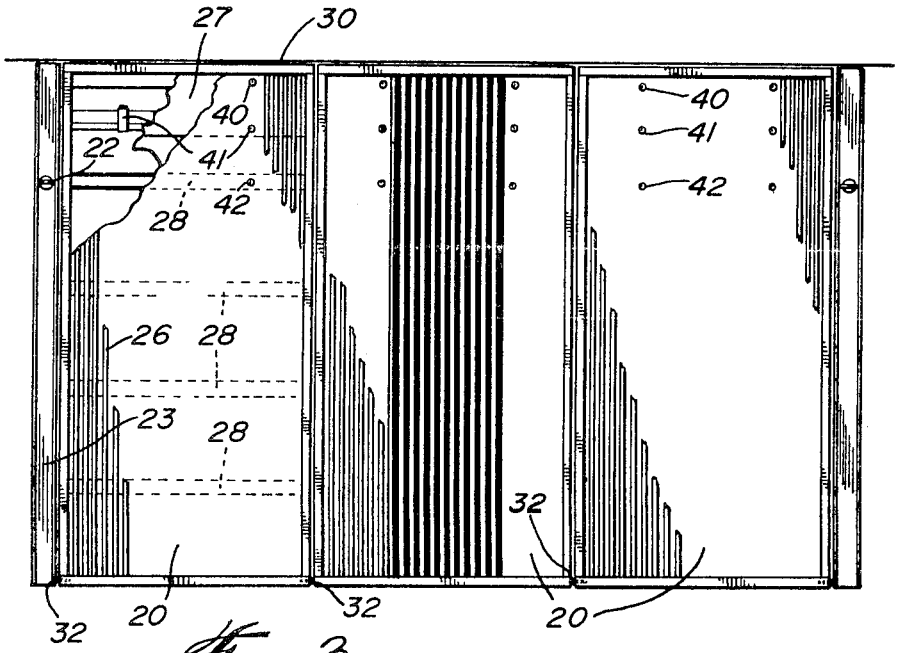
FIG. 3 is a front view of swimmer arrival signal panels at one end of a swimming lane in a swimming pool.
Figure 2:
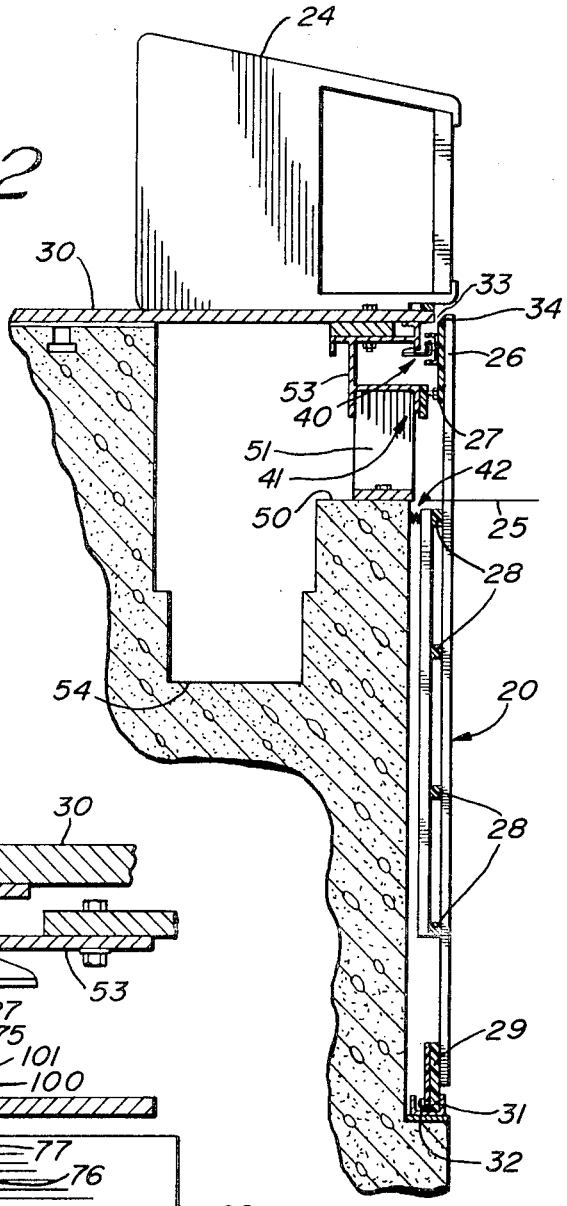
FIG. 2 is a cross sectional side view at one end of a swimming lane in a swimming pool showing a swimmer arrival panel.

The construction of the signal panel 20 is shown in FIGS. 2 and 3 and comprises a plurality of vertical strips 26 mounted side by side and parallel to each other on a top back-up bar 27, four intermediate back-up bars 28 and a bottom back-up bar 29. A frame may enclose the strips 26 to keep them together. The strips 26 are preferably constructed from ABS(acrylonitrile-butadiene-styrene), polycarbonate, PVC(polyvinyl chloride) or other suitable material and are attached to the back-up bars 27, 28 and 29 by a suitable adhesive, mechanical fastening means or combination of both. The panel 20 extends from below water level 25 in the pool to the top anti-skid surface of the top platform panel 30, which may represent the top surface of the edge of the swimming pool or may be on a bulkhead. The bottom back-up bar 29 fits into channel 31 attached to the end wall of the pool and supports the panel 20 vertically at the end of the swimming lane. The back of the back-up bar 29 is fitted with round head screws 32 which provide a fulcrum point and permit the panel to pivot at the fulcrum point. The panel 20 can move forward with the round head screws 32 acting as a pivot.

This construction of signal panel 20 is not fixed or attached to the end of the swimming lane and thus is free to move. This freedom or "float" avoids stress build-up in the panel 20.

The vertical strips 26 are sufficiently rigid so that a swimmer does not find the panel 20 too flexible in a swimming turn when using the panel to kick off for a return lap. The thickness of each strip 26 is substantially the same linear distance as the space between the strips 26. Thus the contact surface area of the strips 26 is approximately half the contact surface area of the panel. This open construction reduces the contact surface area over existing types having perforations in a solid sheet or plate, and permits water to pass through the panel. Thus waves and water currents do not surge against the panel causing the panel to move and activate the switch before the panel is contacted by a swimmer.

In the embodiment shown each strip 26 has a rectangular cross section, $\frac{1}{4}'' \times \frac{3}{4}''$, however, a square cross section, $\frac{3}{4}'' \times \frac{3}{4}''$, may be utilized. The square cross section strips 26 increase the contact surface area of the panel by about 30%, because the space between strips is less than the width of the strip.

An anti-skid surface is located on the top platform panel 30 of the pool or bulkhead. The platform panel 30 adjacent the pool has a sufficient space 33 between the edge of the platform panel 30 and a sloped top edge 34 of the top back-up bar 27 so that movement of the panel 20 is not restricted but is limited by the contacts. A first adjustment device 40 is provided to determine the width of the space 33 between the edge of the platform panel 30 and the top back-up bar 27.

A contact device 41 having an adjustment to determine position of panel 20 when contacts join, and an adjustable spring 42 to determine force required to move the panel, are shown in FIG. 2. Details of these adjustment devices will be described in detail hereafter.

The end of the pool shown in FIG. 2 has a shoulder 50 on which a frame 51 sits supporting a special channel section 53. The section 53 is prepared so that it supports the contact device 41 and provides an abuttment for the first adjustment device 40 to hold the top of the panel 20 in place. The channel section 53 also supports the top platform panel 30 and the starting platform 24 on top of the panel 30. Thus the starting platform, which may be removed when not required, is integrally positioned with the starting panel support structure. The inside of the channel section 10 may also be used for cables for the timing circuits, connecting to each of the contact devices 41. A gutter 54 is shown at the end of the pool, although this is not a requirement for mounting the panel structure.

FIG. 3 shows three panels 20 at one end of a swimming lane. At the bottom edge of each panel 20, between panels and between panels and the rigid vertical strips 23 are round head screws 32 which act as spacers to ensure the panels do not bind together.

Figure 4:
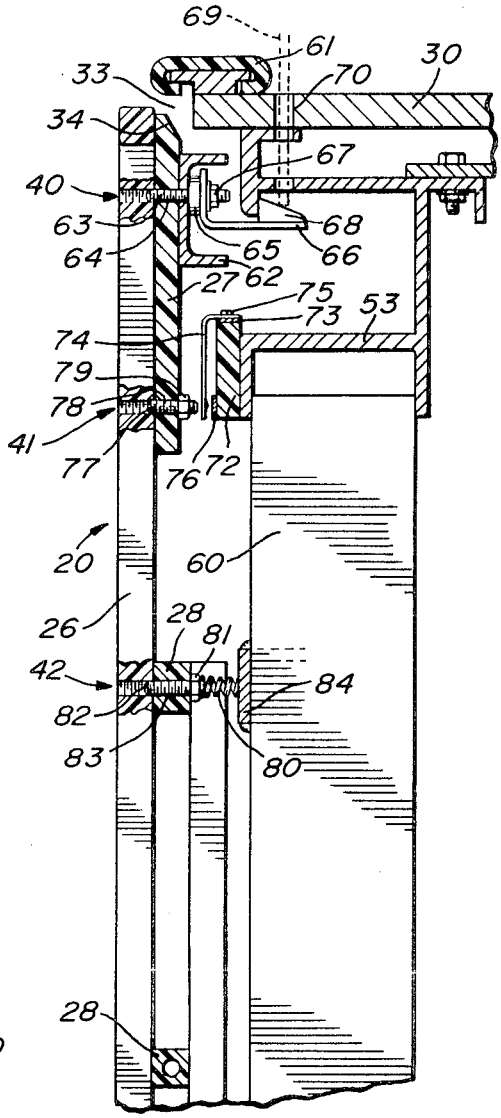
FIG. 4 is a partial cross sectional side view showing details of the top portion of a swimmer arrival panel attached to a bulkhead or a divider.

A top portion of a bulkhead is illustrated in FIG. 4 with the channel section 53 connected to a vertical strut 60 and supporting the top platform 30 which has a molded lip 61 at the front edge. The first adjustment device 40 has a small channel 62 extending along the top back-up bar 27 and has at two positions on each panel, an Allen head screw 63 in a hole 64 in the bar 27 and channel 62 which passes through a compressible washer 65 and a plastic flexible angle 66 having a nut 67 firmly attached to one arm. A retainer piece 68 at the other end of the arm has a sloped surface so the panel may be pushed inwards and engage a protruding piece of the channel section 53. To release the top panel, a rod 69 (shown in dotted line) is inserted through hole 70 in the top platform 30 to push down the flexible arm of angle 66 and release the retainer 68, thus allowing the panel 20 to be pulled away from the bulkhead or end wall.

The space 33 between the edge of the top platform 30 and the sloped edge 34 on the panel 20 is adjusted by rotating the Allen head screw 63 to either reduce or increase the space taken by the compressible washer 65.

The switch mechanism 41 is also shown in FIG. 4 and has a block 72 of non-conductive material attached to and extending along the bottom flange of the channel section 53. A first conductor strip 73 extends along the top of the block 72 and has a right angled depressible tab 74 attached to the first strip 73 by a screw 75. The screw 75 may be removed to replace the tab 74. The end of the tab 74 is spaced apart from a second conductor strip 76 extending along the block 72. An Allen head set screw 77 passes through a hole 78 in the top back-up bar 27 and has a nut 78 attached to the bar 27. The end of the set screw 77 presses the tab 74 when the panel 20 moves inwards so an electrical circuit is completed between the first conductor 73 and the second conductor 76. The position of the panel when the circuit is completed is determined by the position of the set screw 77.

The spring mechanism 42 is shown in FIG. 4. The spring determines the force required to move the panel 20. A spring 80 is attached preferably by epoxy welding to a head 81 of a threaded stud 82 having a socket head at the other end. The stud 82 fits into a tapped hole 83 in the upper intermediate back-up bar 28. A back-up strip 84 attached to the frame member 60 of the bulkhead provides a surface for the spring 80 to contact. Adjustment of the force required to compress the spring may be varied by adjusting the position of stud 82 in the tapped hole 83 by means of the socket head.

The signal panel of the present invention allows three variations for adjustment. First the width of the space 33 between the top sloped edge 34 of the panel 20 and the edge of the top platform 30 may be varied as required by adjustment of the set screw 63 in the tapped hole 64 of the top back-up bar 27. The set screw may be rotated by an Allen key. When this first adjustment has been made, the second adjustment to determine the exact position that the switch is activated is made. This adjustment is carried out by positioning the socket head screw 77 in the tapped hole 78 in the top back-up bar 27 directly over the switch. An Allen key or other equivalent is used to rotate the socket head screw 77. In this manner the exact location of contact between the depressible tab 74 and the second conductor 76 is determined within the movement of the panel. The third adjustment is the spring compression which can be adjusted by means of rotating the socket head screw 82 with an Allen key in the tapped hole 83 of the upper intermediate back-up bar 28. This adjustment is made to ensure that contact by a swimmer on the panel moves the panel to trigger or activate the switch. Too little spring resistance can allow waves to move the panel and prematurely activate the switch, too much spring resistance may prevent the switch from being activated when the panel is touched by a swimmer.

Figure 5:
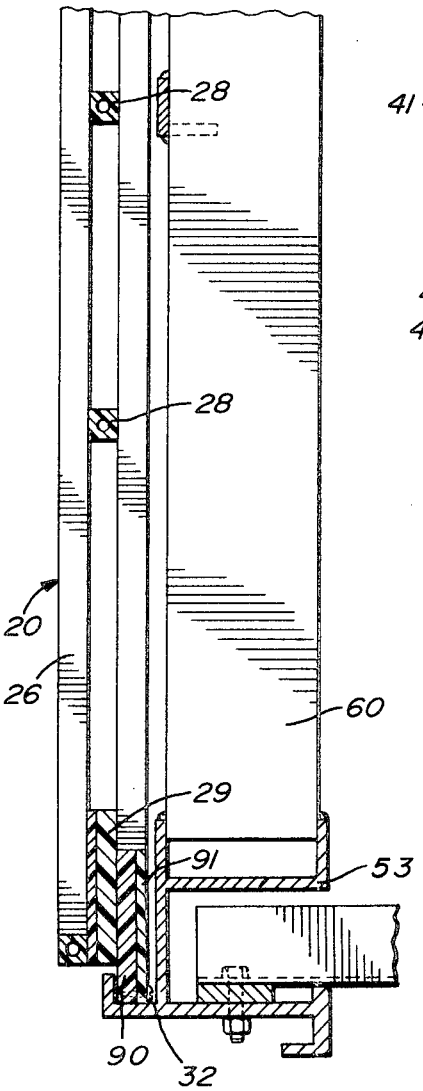
FIG. 5 is a cross sectional side view showing details of the bottom portion of a swimmer arrival panel attached to a bulkhead or a divider.

The bottom of a panel mounted to a bulkhead is shown in FIG. 5. A channel section 53 having the same shape as the section used at the top of the bulkhead is arranged with a groove 90 extending upwards to support an extra support strip 91 attached to the bottom back-up bar 29. At the back of the support strip 91 are round head screws 32 which provide a fulcrum point and permit the panel to pivot at the fulcrum point. The panel can move forward, or "float" with the round head screws acting as a pivot.

Figure 6:
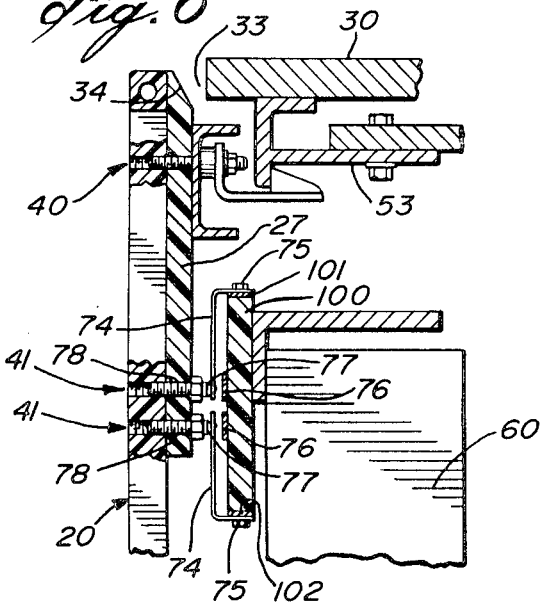
FIG. 6 is a partial cross sectional side view showing details of the top portion of a swimmer arrival panel with two contacts for two separate timing circuits.

Two contact mechanisms are shown in FIG. 6 having a block 100 of non-conductive material attached to the bottom flange of channel section 53. First connector strips 101, 102 extend along the top and bottom of the block 100, both have right angled depressible tabs attached to the strips 101, 102 and second conductor strips 76 which are separate. Two set screws 77 in separate tapped holes 78 in the top back-up bar 27 provide adjustment for the two contacts individually.

It will be apparent to those skilled in the art, that the exact determination of length of a swimming lane is of extreme importance when time measurements for races are made to one-hundredths of a second. Thus, by being able to vary the movement of the panel anywhere from $\frac{1}{8}$–$\frac{1}{4}$ inch and by being able to vary the exact location within that movement that the contact is activated, extremely accurate lane lengths in a swimming pool are allowed. Furthermore, it ensures that all the lanes in the pool are of exact equal length. The force to move the panel 20 can be adjusted so that each panel in each lane activates a switch at the same pressure on the panel, and any minor variations in the construction of the pool, such as at the end of the pool, the or at bulkhead or divider within the pool, can be taken into account by these adjustments.

Various changes may be made to the details of the locking mechanism, spring and contact, without departing from the scope of the present invention. The panel is illustrated as being formed of vertical strips but if desirable a solid plastic sheet or plate may be used with or without perforations. Whereas only one embodiment is illustrated herein, the scope of the invention is not restricted to only one embodiment, but is limited only by the claims.

The embodiments of the invention in which an exclusive property or privilege is claimed are defined as follows:

1. A swimmer arrival signal panel for a swimming lane in a swimming pool, comprising, a panel of non-conductive material, the bottom of the panel adapted for mounting at one end of the swimming lane below water level in the swimming pool, the panel being free to move forward when contacted by a swimmer;

first adjustment means to provide a distance of travel within a predetermined range for the panel;

contact means adapted to be activated when the panel is moved within the distance of travel;

second adjustment means to establish the position of the panel within the distance of travel where the contact means is activated, and adjustable spring means to determine the force required to move the panel.

2. The signal panel according to claim 1 wherein the panel comprises a plurality of vertical strips evenly spaced apart and attached at back faces to a plurality of horizontal reinforcing back-up bars.

3. The signal panel according to claim 2 wherein the thickness of the vertical strips and the distance between the strips is substantially the same, and the contact surface area of the strips is approximately half the surface area of the panel.

4. The signal panel according to claim 1 when utilized to be at least one side of a bulkhead or divider in a swimming pool.

5. The signal panel according to claim 1 when utilized as a permanent fixture on an end wall of a swimming pool.

6. The signal panel according to claim 1 wherein the panel has no permanent fixed connection to the end of the swimming lane.

7. The signal panel according to claim 1 wherein the contact means includes at least one non-corrosive depressible conductive tab, being connected to a first conductor and being spaced from a contact forming part of a second conductor such that depression of the depressible tab touches the contact to complete an electrical circuit between the first and second conductors.

8. The signal panel according to claim 7 wherein the depressible tab is removable and replaceable.

9. The signal panel according to claim 7 wherein at least two depressible tabs and contacts, both connected to the first and second conductors are provided for each panel.

10. The signal panel according to claim 9 wherein at least three signal panels are provided at least at one end of each swimming lane and for each lane of the pool, the panels being rectangular in shape and separated vertically so that each panel may move independently, and any panel within a single lane activates a single electrical circuit for that lane.

11. The signal panel according to claim 1 including a first contact means and a second contact means to provide a first signal and a back-up signal when the panel is moved, and the second adjustment means allows for separate adjustment for the first contact means and the second contact means to establish the position of the panel within the distance of travel where the first and second contact means are activated.

12. The signal panel according to claim 11 wherein the first and second contact means each include at least one non-corrosive depressible conductive tab, being connected to a first conductor and being spaced from a contact forming part of a second conductor such that depression of the depressible tab touches the contact to complete a separate electrical circuit between the first and second conductors for the first contact means and for the second contact means.

13. The signal panel according to claim 1 wherein the first adjustment means includes at least one flexible strip with a retainer attached to the top of the panel, the retainer to engage the end of the swimming lane, and means to depress the flexible strip to release the retainer and disengage the top of the panel from the end of the swimming lane.

14. The signal panel according to claim 5 including a channel section supported on a shoulder of the end wall; the channel section providing a support for a starting platform, and a raceway for cables connected to the contact means.

15. The signal panel according to claim 4 including a channel section of the same cross section at the top and bottom of the bulkhead or divider, the bottom of the panel fitting into a slot in the channel section at the bottom of the bulkhead and a releasable retainer attached to the top of the panel to engage the channel section at the top of the bulkhead.

* * * * *